US008552831B2

(12) United States Patent
Ueda et al.

(10) Patent No.: US 8,552,831 B2
(45) **Date of Patent: *Oct. 8, 2013**

(54) CHIP VARISTOR

(75) Inventors: Kaname Ueda, Tokyo (JP); Katsunari Moriai, Tokyo (JP); Takahiro Itami, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/587,310

(22) Filed: Aug. 16, 2012

(65) Prior Publication Data

US 2013/0049922 A1 Feb. 28, 2013

(30) Foreign Application Priority Data

Aug. 29, 2011 (JP) ..... 2011-186184

(51) Int. Cl.
*H01C 7/10* (2006.01)

(52) U.S. Cl.
USPC ..... 338/20; 338/13; 338/21

(58) Field of Classification Search
USPC ..... 338/20, 21
See application file for complete search history.

(56) References Cited

U.S. PATENT DOCUMENTS

| | | | | |
|---|---|---|---|---|
| 6,232,867 | B1 * | 5/2001 | Yoshida et al. | 338/21 |
| 6,400,253 | B1 * | 6/2002 | Jinno et al. | 338/332 |
| 7,649,435 | B2 | 1/2010 | Moriai et al. | |
| 7,724,123 | B2 | 5/2010 | Matsuoka et al. | |
| 7,864,025 | B2 * | 1/2011 | Katsumura et al. | 338/21 |
| 7,940,155 | B2 | 5/2011 | Katsumura et al. | |
| 7,994,894 | B2 | 8/2011 | Sato et al. | |
| 2012/0139688 | A1 * | 6/2012 | Ueda et al. | 338/21 |

FOREIGN PATENT DOCUMENTS

| | | | |
|---|---|---|---|
| JP | 1-93704 | * | 6/1989 |
| JP | A-2002-246207 | | 8/2002 |
| JP | A-2005-302937 | | 10/2005 |
| JP | 2006-344751 | * | 12/2006 |
| JP | 2009-277801 | * | 11/2009 |

OTHER PUBLICATIONS

Jan. 8, 2013 Office Action issued in Japanese Patent Application No. 2010-271326.
U.S. Appl. No. 13/587,326 in the name of Ueda et al., filed Aug. 16, 2012.
U.S. Appl. No. 13/295,606 in the name of Ueda et al., filed Nov. 14, 2011.
Jun. 12, 2013 Notice of Allowance issued in U.S. Appl. No. 13/295,606.
Mar. 1, 2013 Office Action issued in U.S. Appl. No. 13/295,606.
Apr. 30, 2013 Office Action issued in U.S. Appl. No. 13/587,326.

* cited by examiner

*Primary Examiner* — Kyung Lee
(74) *Attorney, Agent, or Firm* — Oliff & Berridge, PLC

(57) ABSTRACT

A chip varistor is provided with a varistor section and a plurality of terminal electrodes. The varistor section is comprised of a sintered body containing ZnO as a major component, exhibits the nonlinear voltage-current characteristics, and has a pair of principal surfaces opposed to each other. The plurality of terminal electrodes are connected each to the varistor section. Each of the terminal electrodes has a first electrode portion connected to either of the principal surfaces and a second electrode portion connected to the first electrode portion.

6 Claims, 8 Drawing Sheets

CHIP VARISTOR

BACKGROUND OF THE INVENTION

1. Field of the Invention

The present invention relates to a chip varistor.

2. Related Background Art

One of known chip varistors is a multilayer chip varistor provided with a varistor element body having a varistor layer and internal electrodes arranged with the varistor layer in between, and also provided with terminal electrodes arranged at ends of the varistor element body so as to be connected to the corresponding internal electrodes (e.g., cf. Japanese Patent Application Laid-open No. 2002-246207). In the multilayer chip varistor, a region between the internal electrodes in the varistor layer functions as a region to exhibit the nonlinear voltage-current characteristics (hereinafter also referred to as "varistor characteristics").

SUMMARY OF THE INVENTION

In recent high-speed interfaces, the structure of IC itself is becoming weak against ESD (Electrostatic Discharge), in order to realize increase in speed. For this reason, there are increasing demands for countermeasures against ESD in high-speed transmission type IC and the aforementioned multilayer chip varistor is used as an ESD-resistant component. The ESD-resistant component for high-speed transmission system is required to have the essential feature of reduction in capacitance. If the component demonstrates a large capacitance, it will raise a problem in quality of signal and can cause failure in communication in the worst case.

A conceivable technique to reduce the capacitance of the multilayer chip varistor is to decrease the area of mutually overlapping portions of the internal electrodes arranged in contact with the varistor layer. The decrease in the area of the mutually overlapping portions of the internal electrodes leads to a decrease in a region to exhibit the capacitance, thereby to reduce the capacitance.

However, when the area of the mutually overlapping portions of the internal electrodes (which will be referred to hereinafter as "overlap area") is small, there arises a new problem of reduction in tolerance against ESD (which will be referred to hereinafter as "ESD tolerance"). When a surge voltage like ESD is applied, an electric field distribution in the mutually overlapping portions of the internal electrodes is concentrated at edges of the mutually overlapping portions of the internal electrodes. If the electric field distribution in the mutually overlapping portions of the internal electrodes is concentrated at the edges, the ESD tolerance will suddenly decrease with decrease in the overlap area.

The multilayer chip varistor has the internal electrodes arranged in contact with the varistor layer, as described above. For this reason, it was difficult to maintain a sufficient ESD tolerance.

An object of the present invention is to provide a chip varistor capable of maintaining a sufficient ESD tolerance, without inclusion of the aforementioned internal electrodes.

The present invention provides a chip varistor comprising: a varistor section comprised of a sintered body containing ZnO as a major component, configured to exhibit the nonlinear voltage-current characteristics, and having a pair of principal surfaces opposed to each other; and a plurality of terminal electrodes connected to the varistor section, wherein each of the terminal electrodes has a first electrode portion connected to either of the principal surfaces and a second electrode portion connected to the first electrode portion.

In the present invention, the terminal electrodes have their respective first electrode portions connected to the corresponding principal surfaces of the varistor section and thus the varistor section to exhibit the varistor characteristics is sandwiched in between the first electrode portions and connected thereto. The chip varistor of the present invention, different from the aforementioned multilayer chip varistor, exhibits the varistor characteristics, without inclusion of the internal electrodes arranged in contact with the varistor layer. For this reason, even if a surge voltage like ESD is applied, the electric field distribution is not concentrated anywhere in the varistor section, so as to cause no reduction in ESD tolerance.

The chip varistor may be configured as follows: the varistor section includes a first region where at least one element selected from the group consisting of alkali metals, Ag, and Cu exists, and a second region extending between the pair of principal surfaces and containing no element selected from the group consisting of alkali metals, Ag, and Cu; the first electrode portions are connected to the second region.

The varistor section comprised of the sintered body containing ZnO as a major component includes the first region where the at least one element selected from the group consisting of alkali metals, Ag, and Cu exists. In the varistor section, the first region where the at least one element selected from the group consisting of alkali metals, Ag, and Cu exists has the electric conductivity and relative permittivity lower than the second region containing no element selected from the group consisting of alkali metals, Ag, and Cu. The capacitance of the chip varistor can be represented by the capacitance of the varistor section located between the terminal electrodes. Therefore, when the varistor section includes the first region, the capacitance of the varistor section becomes lower, so as to achieve reduction in the capacitance of the chip varistor.

In general, terminal electrodes of an electronic component are formed by applying an electroconductive paste containing a metal and a glass component, onto an element body forming the electronic component, and sintering it. In this case, since the terminal electrodes contain the glass component, the coverage of the metal in the terminal electrodes over the element body can vary because of it. When the coverage of the metal varies in the terminal electrodes of the chip varistor, it can cause variation in the capacitance of the chip varistor.

When the terminal electrodes are formed using the electroconductive paste as described above, the electroconductive paste is applied so as to wrap around the end faces of the element body and portions of the side faces adjacent to the end faces. The terminal electrodes generally have portions formed so as to wrap around the side faces, and if there is variation in length of the portions, there will occur variation in the area covered by the metal in the terminal electrodes. In this case, the coverage of the metal will also vary, so as to cause variation in the capacitance of the chip varistor.

When the first region where the at least one element selected from the group consisting of alkali metals, Ag, and Cu exists is formed by diffusing the element from the exterior surfaces of the electroconductive sections on which the terminal electrodes are formed, the variation in length of the portions wrapping around the side faces of the terminal electrodes also leads to variation in size of the first regions. When there is variation in size of the first regions in the electroconductive sections as in this case, the capacitance of the chip varistor also varies.

In the chip varistor, as described above, the capacitance can vary because of the various factors. In contrast to it, the first electrode portion is connected to the second region in the electroconductive section, and thus it can suppress the variation in capacitance.

The first electrode portions may be arranged so as to cover the respective principal surfaces. In this case, it is feasible to securely prevent the variation in capacitance.

The first electrode portions may be formed by co-firing an electroconductive paste containing a metal and containing no glass component, together with the varistor section. In this case, it is feasible to securely prevent the variation in capacitance.

The varistor section may contain at least one element selected from the group consisting of rare earth metals and Bi, as a minor component.

The first region of the varistor section may be located on the exterior surface side of the varistor section so as to surround an outer periphery of the second region of the varistor section, when viewed from an opposing direction of the pair of principal surfaces. In this case, the electric conductivity is lower on the exterior surface side of the varistor section and therefore surface current is less likely to flow on the exterior surface of the varistor section. As a result, it is feasible to prevent occurrence of leakage current.

The chip varistor may further comprise another varistor section arranged so that the first electrode portion is sandwiched in between the varistor sections. In this case, even if the first region where the at least one element selected from the group consisting of alkali metals, Ag, and Cu exists is formed by diffusing the element from the exterior surface of the varistor section without formation of the terminal electrodes, the first electrode portions are securely connected to the second region.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The preferred embodiments of the present invention will be described below in detail with reference to the accompanying drawings. In the description the same elements or elements with the same functionality will be denoted by the same reference signs, without redundant description.

Figure 1:
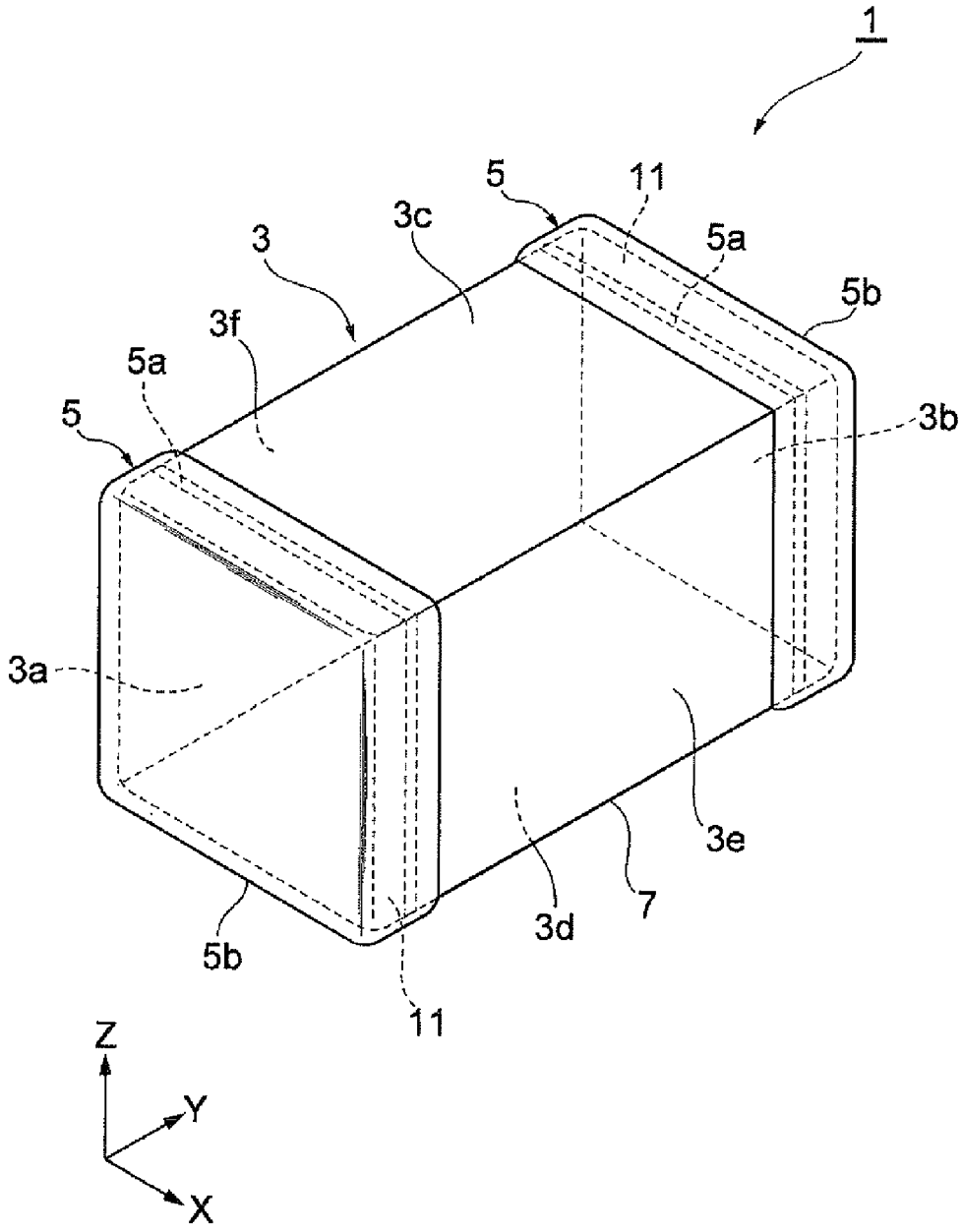
FIG. 1 is a perspective view illustrating the chip varistor according to an embodiment of the present invention.
Figure 2:
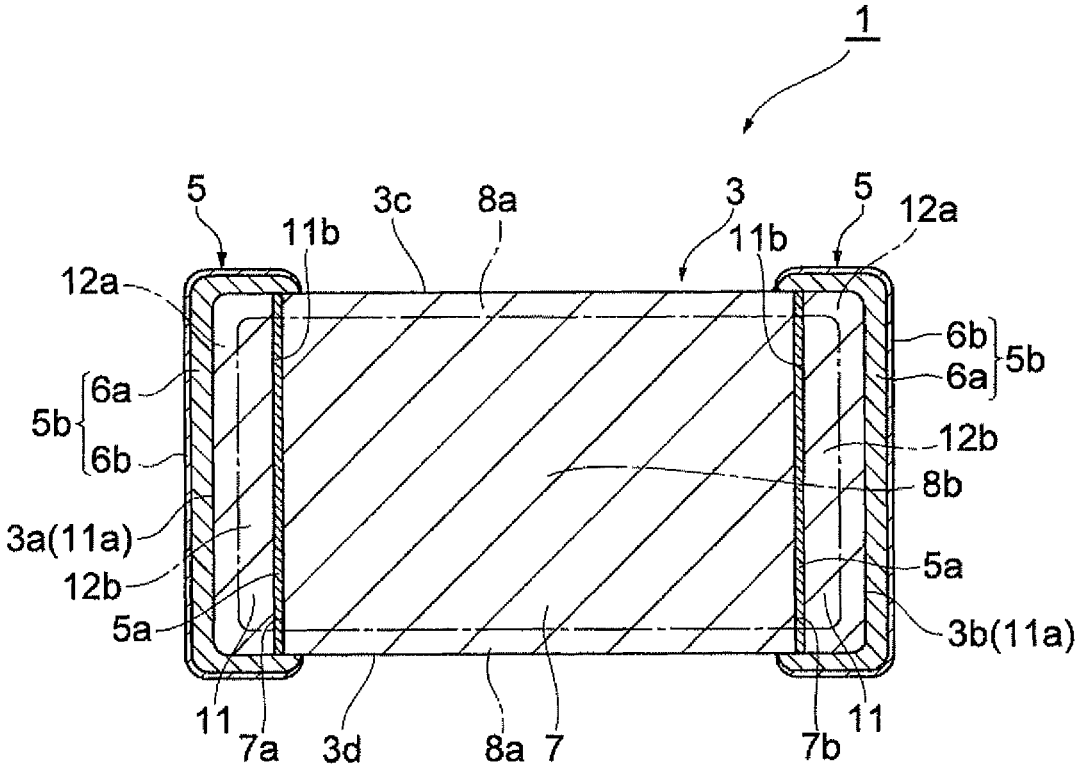
FIG. 2 is a drawing for explaining a cross-sectional configuration of the chip varistor according to the embodiment.
Figure 3:
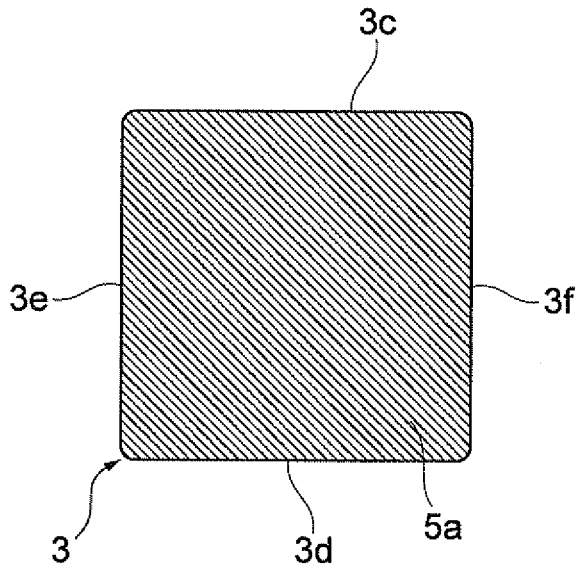
FIG. 3 is a drawing for explaining a cross-sectional configuration of a first electrode portion of the chip varistor according to the embodiment.
Figure 4:
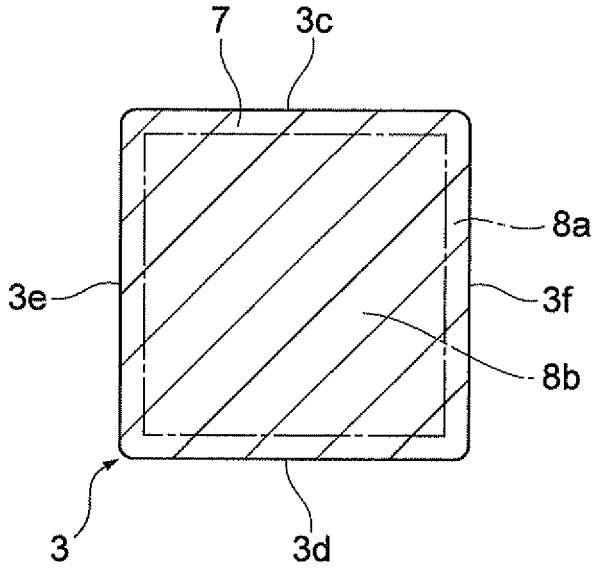
FIG. 4 is a drawing for explaining a cross-sectional configuration of a first varistor section of the chip varistor according to the embodiment.
Figure 5:
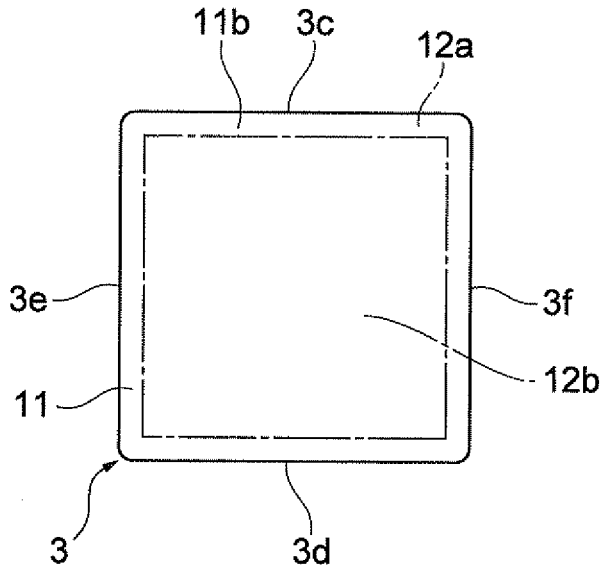
FIG. 5 is a drawing for explaining a configuration of a second varistor section of the chip varistor according to the embodiment.

First, a configuration of a chip varistor 1 according to an embodiment of the present invention will be described with reference to FIGS. 1-6. FIG. 1 is a perspective view illustrating the chip varistor according to the embodiment. FIG. 2 is a drawing for explaining a cross-sectional configuration of the chip varistor according to the embodiment. FIG. 3 is a drawing for explaining a cross-sectional configuration of a first electrode portion of the chip varistor according to the embodiment. FIG. 4 is a drawing for explaining a cross-sectional configuration of a first varistor section of the chip varistor according to the embodiment. FIG. 5 is a drawing for explaining a configuration of a second varistor section of the chip varistor according to the embodiment.

The chip varistor 1, as shown in FIG. 1, is provided with an element body 3 of a nearly rectangular parallelepiped shape and a pair of terminal electrodes 5. The chip varistor 1 is, for example, a chip varistor of an extremely small size (so called 0402 size) having the length of 0.4 mm in the Y-direction, the height of 0.2 mm in the Z-direction, and the width of 0.2 mm in the X-direction in the drawing.

The element body 3 has a first varistor section 7 and a plurality of second varistor sections (two second varistor sections in the present embodiment) 11. The element body 3 has end faces 3*a*, 3*b* of a square shape opposed to each other, and four side faces 3*c*-3*f* perpendicular to the end faces 3*a*, 3*b*, as its exterior surface. The four side faces 3*c*-3*f* extend so as to connect the end faces 3*a*, 3*b*.

The first varistor section 7, as shown in FIGS. 1 and 2, is a part of a rectangular parallelepiped shape located nearly in the center of the element body 3 and is comprised of a sintered body (semiconductor ceramic) to exhibit the varistor characteristics. The first varistor section 7 includes a pair of principal surfaces 7*a*, 7*b* opposed to each other in its thickness direction (or the Y-direction in the drawing). The thickness of the first varistor section 7 is set, for example, in the range of about 150 to 900 μm.

The second varistor sections 11, as shown in FIGS. 1 and 2, are parts of a nearly rectangular parallelepiped shape located in regions nearer to the two ends of the element body 3. The second varistor sections 11 have respective principal surfaces 11*a* constituting the end faces 3*a*, 3*b* of the element body 3, and respective principal surfaces 11*b* opposed to the corresponding principal surfaces 11*a*.

The first and second varistor sections 7, 11 contain ZnO (zinc oxide) as a major component and also contain minor components of metals such as Co, rare earth metal, Group IIIb element (B, Al, Ga, In), Si, Cr, Mo, alkali metal (K, Rb, Cs), and alkaline-earth metal (Mg, Ca, Sr, Ba), or oxides thereof. In the present embodiment the first and second varistor sections 7, 11 contain Co, Pr, Cr, Ca, K, and Al as minor components. There are no particular restrictions on the content of ZnO in the first and second varistor sections 7, 11, but it is usually from 99.8 to 69.0% by mass when the total content of all materials constituting the first and second varistor sections 7, 11 is 100% by mass.

The rare earth metal (e.g., Pr) acts as a substance to exhibit the varistor characteristics. The content of the rare earth metal in the first and second varistor sections 7, 11 is set, for example, in the range of about 0.01 to 10 atomic %.

Each of the terminal electrodes 5 has a first electrode portion 5*a* and a second electrode portion 5*b*. The first electrode portion 5*a* of each terminal electrode 5 is arranged between the first varistor section 7 and the second varistor section 11. Each second electrode portion 5*b* is connected to the first electrode portion 5*a* and the second electrode portions 5*b* are arranged at the two ends of the element body 3.

Each first electrode portion 5*a* is connected directly to the principal surface 7*a* or 7*b* of the first varistor section 7 and connected directly to the principal surface 11*b* of the corresponding second varistor section 11. Namely, each first electrode portion 5*a* is located in between the first varistor section 7 and the second varistor section 11. Each first electrode portion 5*a* is formed so as to cover the entire area of the principal surface 7*a* or 7*b* of the first varistor section 7 and the entire area of the principal surface 11*b* of the second varistor section 11. Namely, the first electrode portion 5*a*, as shown in FIG. 3, has a nearly rectangular shape. The edges of the first electrode portion 5*a* are exposed in the four side faces 3*c*-3*f* of the element body 3. The first electrode portion 5*a* is comprised of a metal (e.g., Pd, Ag, or an Ag—Pd alloy). The first electrode portion 5*a* is constructed as a sintered body of an electroconductive paste containing a powder consisting of the foregoing metal, an organic binder, and an organic solvent. The electroconductive paste for formation of the first electrode portion 5*a* contains no glass component (e.g., such as glass fit).

The second electrode portions 5*b* are formed in a multilayer form so as to cover the respective end faces 3*a*, 3*b* of the element body 3 (principal surfaces 11*a* of the second varistor sections 11) and portions of the four side faces 3*c*-3*f* nearer to the respective end faces 3*a*, 3*b*. Each of the second electrode portions 5*b* is formed so as to also cover the edges of the first electrode portion 5*a* exposed in the four side faces 3*c*-3*f* of the element body 3 and therefore is connected directly to the first electrode portion 5*a*. Each second electrode portion 5*b* includes a first electrode layer 6*a* and a second electrode layer 6*b*.

The first electrode layers 6*a* are formed by applying an electroconductive paste onto the surface of the element body 3 and sintering it. Namely, the first electrode layers 6*a* are sintered electrode layers. The electroconductive paste used herein is one obtained by mixing a glass component, an organic binder, and an organic solvent in a powder consisting of a metal (e.g., Pd, Cu, Ag, or an Ag—Pd alloy). The second electrode layers 6*b* are formed by plating on the corresponding first electrode layers 6*a*. In the present embodiment, each second electrode layer 6*b* includes an Ni-plated layer formed by Ni plating on the first electrode layer 6*a*, and an Sn-plated layer formed by Sn plating on the Ni-plated layer.

Each of the first varistor section 7 and the second varistor sections 11, as also shown in FIGS. 4-5, includes a first region 8*a*, 12*a* and a second region 8*b*, 12*b*, respectively. The first regions 8*a*, 12*a* contain at least one element selected from the group consisting of alkali metals, Ag, and Cu. In the first regions 8*a*, 12*a*, the at least one element selected from the group consisting of alkali metals, Ag, and Cu exists in a solid solution form in crystal grains of ZnO, or exists at crystal grain boundaries of ZnO. In the second regions 8*b*, 12*b*, there is no element selected from the group consisting of alkali metals, Ag, and Cu. In the present embodiment, the foregoing element to be used is an alkaline metal, particularly, Li. Li has the relatively small ion radius, is easy to form a solid solution in crystal grains of ZnO, and also has a high diffusion rate. In the first regions 8*a*, 12*a*, there may be two or more elements selected from the group consisting of alkali metals, Ag, and Cu.

In the first varistor section 7, the second region 8*b* is located nearly in the center of the first varistor section 7, when viewed from the opposing direction of the pair of principal surfaces 7*a*, 7*b*, as shown in FIG. 4. The second region 8*b* extends between the principal surface 7*a* and the principal surface 7*b* when viewed from a direction perpendicular to the opposing direction of the pair of principal surfaces 7*a*, 7*b*. Namely, the second region 8*b* extends between the pair of first electrode portions 5*a* to be connected to the first electrode portions 5*a*. The first region 8*a* is located on the exterior surface side of the first varistor section 7 so as to surround the outer periphery of the second region 8*b*, when viewed from the opposing direction of the pair of principal surfaces 7*a*, 7*b*.

In each of the second varistor sections 11, the second region 12*b* is located nearly in the center of the second varistor section 11, when the principal surface 11*b* is viewed from the direction perpendicular to the principal surface 11*b*, as shown in FIG. 5. The second region 12*b* does not reach the principal surface 11*a*, when viewed from a direction perpendicular to the opposing direction of the pair of principal surfaces 11*a*, 11*b*. The second region 12*b* is connected to the first electrode portion 5*a*. The first region 12*a* is located on the exterior surface side of the second varistor section 11 so as to surround the outer periphery of the second region 12*b*.

When the element selected from the group consisting of alkali metals, Ag, and Cu exists in the solid solution form in the crystal grains of ZnO, the element reduces donors in ZnO demonstrating the property as an n-type semiconductor. For this reason, ZnO comes to have lower electric conductivity and becomes less likely to exhibit the varistor characteristics. It is also considered that the electric conductivity becomes lower when the foregoing element exists at crystal grain boundaries of ZnO. Therefore, the first regions 8*a*, 12*a* have lower electric conductivity and lower capacitance than the second regions 8*b*, 12*b*.

In the first varistor section 7, the second region 8*b* functions mainly as a region to exhibit the varistor characteristics. The first electrode portions 5*a* are connected directly to the second region 8*b* functioning as a region to exhibit the varistor characteristics. Each of the second varistor sections 11 does not exhibit the varistor characteristics.

Figure 6:
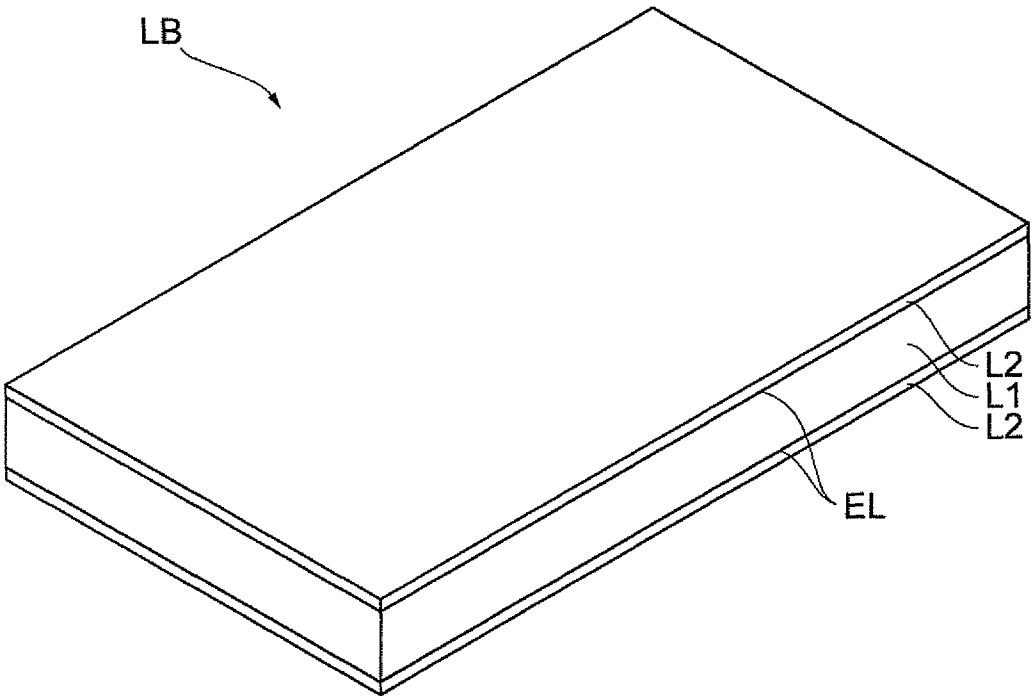
FIG. 6 is a drawing for explaining a manufacturing process of the chip varistors according to the embodiment.
Figure 7:
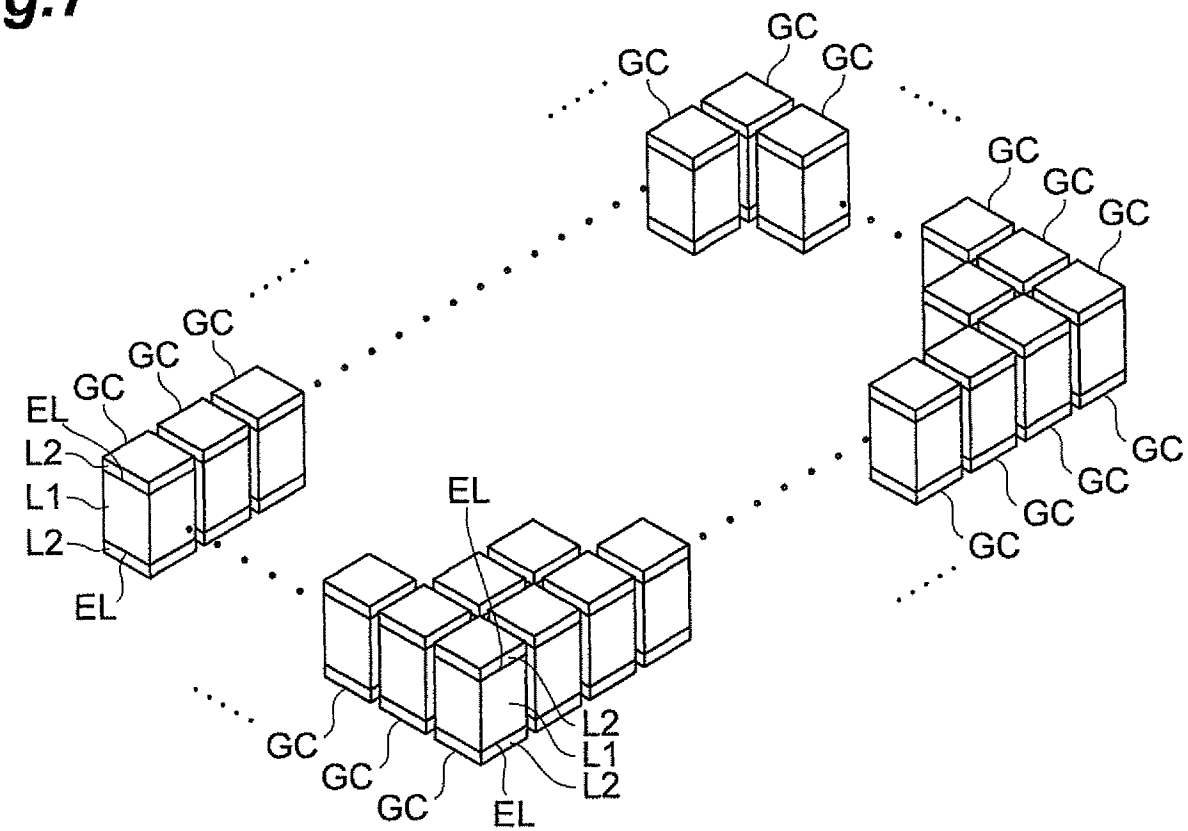
FIG. 7 is a drawing for explaining the manufacturing process of the chip varistors according to the embodiment.

An example of a manufacturing process of chip varistors 1 having the above-described configuration will be described below with reference to FIGS. 6 and 7. FIGS. 6 and 7 are drawings for explaining the manufacturing process of the chip varistors according to the embodiment.

First, ZnO as the major component of the first and second varistor sections 7, 11, and the trace additives such as metals or oxides of Co, Pr, Cr, Ca, K, and Al each are weighed at a predetermined ratio and then these components are mixed to prepare a varistor material. Thereafter, further additives such as an organic binder, an organic solvent, and an organic plasticizer are added in this varistor material and they are mixed and pulverized with a ball mill or the like to obtain a slurry. This slurry is applied onto films, e.g., of polyethylene terephthalate by a known method such as the doctor blade method, and dried to form membranes in a predetermined thickness (e.g., about 30 μm). The membranes obtained as described above are peeled off from the films to obtain first green sheets.

Next, electrode patterns corresponding to the first electrode portions 5*a* are formed on the green sheets. The electrode patterns corresponding to the first electrode portions 5*a* are formed by printing patterns of an electroconductive paste as a mixture of a powder consisting of the aforementioned metal, an organic binder, and an organic solvent, by a printing method such as screen printing, and drying it. The powder consisting of the metal contains, for example, Pd, Ag, or an Ag—Pd alloy as a major component.

Next, the green sheets with the electrode patterns formed thereon and green sheets without formation of the electrode patterns are stacked each by a predetermined number. The green sheets herein are stacked so that the green sheets with the electrode patterns thereon are sandwiched in between varistor green layers consisting of a plurality of green sheets without formation of the electrode patterns. Thereafter, the stacked green sheets are pressed under pressure so that the green sheets become bonded to each other. The thickness of the varistor green layer is adjusted by the number of first green sheets. The number of green sheets with the electrode patterns thereon may also be at least one.

The above processes result in preparing a laminate body LB in which the varistor green layer L1, the varistor green layers L2, and the electrode patterns EL are laminated together, as shown in FIG. 6.

Next, the laminate body LB is dried and thereafter, as shown in FIG. 7, it is cut in chip units to obtain a plurality of green element bodies GC (element bodies 3 before fired). The cutting of the laminate body LB is performed, for example, with a dicing saw or the like.

Next, the plurality of green element bodies GC are subjected to a thermal treatment under predetermined conditions (e.g., 180-400° C. and 0.5 to 24 hours) to implement debindering, and thereafter further fired under predetermined conditions (e.g., 1000-1400° C. and 0.5 to 8 hours). This firing process results in turning the varistor green layer L1 into the first varistor section 7, turning the varistor green layers L2 into the second varistor sections 11, and turning the electrode patterns EL into the first electrode portions 5*a*, thereby obtaining a plurality of element bodies 3 in each of which the first varistor section 7 is sandwiched in between the first electrode portions 5*a* and the first electrode portions 5*a* is sandwiched in between the first varistor section 7 and the second varistor sections 11. The varistor green layers L1, L2 and the electrode patterns EL are fired together. After the firing process, the element bodies 3 may be polished by barrel polishing if necessary. The barrel polishing may be carried out before the firing, i.e., after the cutting of the laminate body LB.

Next, at least one element selected from the group consisting of alkali metals (e.g., Li, Na, and so on), Ag, and Cu is diffused from the exterior surface of the element body 3 (the pair of end faces 3*a*, 3*b* and the four side faces 3*c*-3*f*). The below will describe an example of diffusion of an alkali metal element.

First, an alkali metal compound is attached to the exterior surface of the element body 3. The attachment of the alkali metal compound can be implemented using a hermetically-closed rotary pot. There are no particular restrictions on the alkali metal compound, but it is a compound that can diffuse the alkali metal from the surface of the element body 3 when subjected to a thermal treatment, and can be an oxide, a hydroxide, a chloride, a nitrate, a borate, a carbonate, an oxalate, or the like of the alkali metal.

Then the element body 3 with the alkali metal compound attached thereto is thermally treated at a predetermined temperature and for a predetermined time in an electric furnace. This thermal treatment results in diffusing the alkali metal from the alkali metal compound through the exterior surface of the element body 3 into the interior. A preferred thermal treatment temperature is from 700° C. to 1000° C. and a thermal treatment atmosphere is the atmosphere. A thermal treatment time (retention time) is preferably from 10 minutes to 4 hours.

The portions in the element body 3 (first and second varistor sections 7, 11) where the alkali metal element has diffused, i.e., the first regions 8*a*, 12*a* where the alkali metal element exists, come to have higher resistance and lower capacitance as described above. In the present embodiment, the alkali metal element diffuses through the end faces 3*a*, 3*b*, but it does not inhibit the electrical connection between the terminal electrodes 5 and the first varistor section 7 (second region 8*b*) because of the existence of the second varistor sections 11.

Next, an electroconductive paste is applied so as to cover the two end faces 3*a*, 3*b* of each element body 3 and thermally treated to bake the electroconductive paste on the element body 3 to form the first electrode layers 6*a* of the second electrode portions 5*b*. Thereafter, electroplating treatments such as Ni plating and Sn plating are carried out so as to cover the first electrode layers 6*a*, thereby forming the second electrode layers 6*b*. These result in forming the terminal electrodes 5 on the both end sides of the element body 3. The terminal electrodes 5 are formed on both end sides in the direction in which the first varistor section 7 is sandwiched in between the first electrode portions 5*a*, in the element body 3. The electroconductive paste for formation of the first electrode layers 6*a* can be, for example, one in which a glass frit and an organic vehicle are mixed in a metal powder. The metal powder can be, for example, one containing Cu, Ag, or an Ag—Pd alloy as a major component.

The chip varistors 1 are obtained through these processes.

In the present embodiment, since the terminal electrodes 5 have the first electrode portions 5*a* connected to the respective principal surfaces 7*a*, 7*b* of the first varistor section 7, the first varistor section 7 to exhibit the varistor characteristics is sandwiched in between the first electrode portions 5*a* and connected thereto. The chip varistor 1, different from the aforementioned multilayer chip varistor, exhibits the varistor characteristics, without inclusion of the internal electrodes arranged in contact with the varistor layer. For this reason, even if a surge voltage like ESD is applied, the electric field distribution is not concentrated anywhere in the first varistor section 7, so as to cause no reduction in ESD tolerance.

In the present embodiment the first varistor section 7 includes the first region 8*a*. The first region 8*a* has the electric conductivity and relative permittivity lower than the second region 8*b*. The capacitance of the chip varistor 1 can be represented by the capacitance of the first varistor section 7 located between the first electrode portions 5*a* of the terminal electrodes 5. Therefore, since the first varistor section 7 includes the first region 8*a*, the capacitance of the first varistor section 7 becomes lower, so as to achieve reduction in the capacitance of the chip varistor 1.

In the multilayer chip varistor, the area of the mutually overlapping portions of the internal electrodes can vary because of such factors as accuracy of formation of the electrode patterns on the varistor green sheets, deviation of stacking of the varistor green sheets, or deviation of cutting of the laminate body. The variation in the area of the mutually overlapping portions of the internal electrodes will lead to variation in the capacitance established by the mutually overlapping portions of the internal electrodes. In contrast to it, the chip varistor 1 includes no internal electrodes, as described above, so as to cause no variation in capacitance due to the internal electrodes.

In general, terminal electrodes of an electronic component are formed by applying an electroconductive paste containing a metal and a glass component, onto an element body and thereafter sintering it. In this case, since the terminal electrodes contain the glass component, the coverage of the metal in the terminal electrodes over the element body can vary because of it. When the coverage of the metal varies in the terminal electrodes of the chip varistor, there occurs variation in the capacitance of the chip varistor.

When the terminal electrodes are formed using the electroconductive paste, the electroconductive paste is applied so as to wrap around the end faces of the element body and portions of the side faces adjacent to the end faces. The terminal electrodes have the portions formed so as to wrap around the side faces, and if there occurs variation in length of the portions, there will also arise variation in the area covered by the metal. In this case, the coverage of the metal will also vary, so as to cause variation in the capacitance of the chip varistor.

In the chip varistor, as described above, the capacitance can vary because of the various factors. In the present embodiment, however, the first electrode portions 5*a* are connected to the corresponding second region 8*b* in the first varistor section 7, which can suppress occurrence of variation in the capacitance of the chip varistor 1.

Each first electrode portions 5*a* is arranged so as to cover the entire area of the principal surface 7*a* or 7*b* of the first varistor section 7. This configuration enables secure suppression of the variation in the capacitance of the chip varistor 1.

The first electrode portions 5*a* are formed by co-firing the electroconductive paste containing the metal and containing no glass component, together with the first and second varistor section 7, 11. Since the first electrode portions 5*a* contain no glass component, the coverage of the metal in the first electrode portions 5*a* is less likely to vary. This enables secure suppression of the variation in the capacitance of the chip varistor 1.

The first electrode portions 5*a* are formed by co-firing the electroconductive paste containing the powder consisting of the metal and containing no glass component, together with the first and second varistor section 7, 11. This also enables secure suppression of the variation in the capacitance of the chip varistor 1.

In the present embodiment, the first region 8*a* of the first varistor section 7 is located on the exterior surface side of the first varistor section 7 so as to surround the outer periphery of the second region 8*b*, when viewed from the opposing direction of the pair of principal surfaces 7*a*, 7*b*. Since the electric conductivity is lower on the exterior surface side of the first varistor section 7, surface current is less likely to flow on the exterior surface of the first varistor section 7. As a result, occurrence of leakage current is suppressed in the chip varistor 1.

In the present embodiment, at least one element selected from the group consisting of alkali metals, Ag, and Cu is diffused from the exterior surface of the element body 3 (end faces 3*a*, 3*b* and side faces 3*c*-3*f*). For this reason, it is easy to control the range of diffusion of the at least one element selected from the group consisting of alkali metals, Ag, and Cu.

In the present embodiment, each of the second varistor sections 11 is arranged so that the first electrode portion 5*a* is sandwiched in between the first varistor section 7 and the second varistor section 11. For this reason, even in the case where the aforementioned element is diffused from the end faces 3*a*, 3*b* of the element body 3 to form the first regions 12*a* where the at least one element selected from the group consisting of alkali metals, Ag, and Cu exists, the element is unlikely to reach the first electrode portions 5*a* from the end faces 3*a*, 3*b*. As a result, the first electrode portions 5*a* are securely connected to the second region 8*b* in the first varistor section 7.

Figure 8:
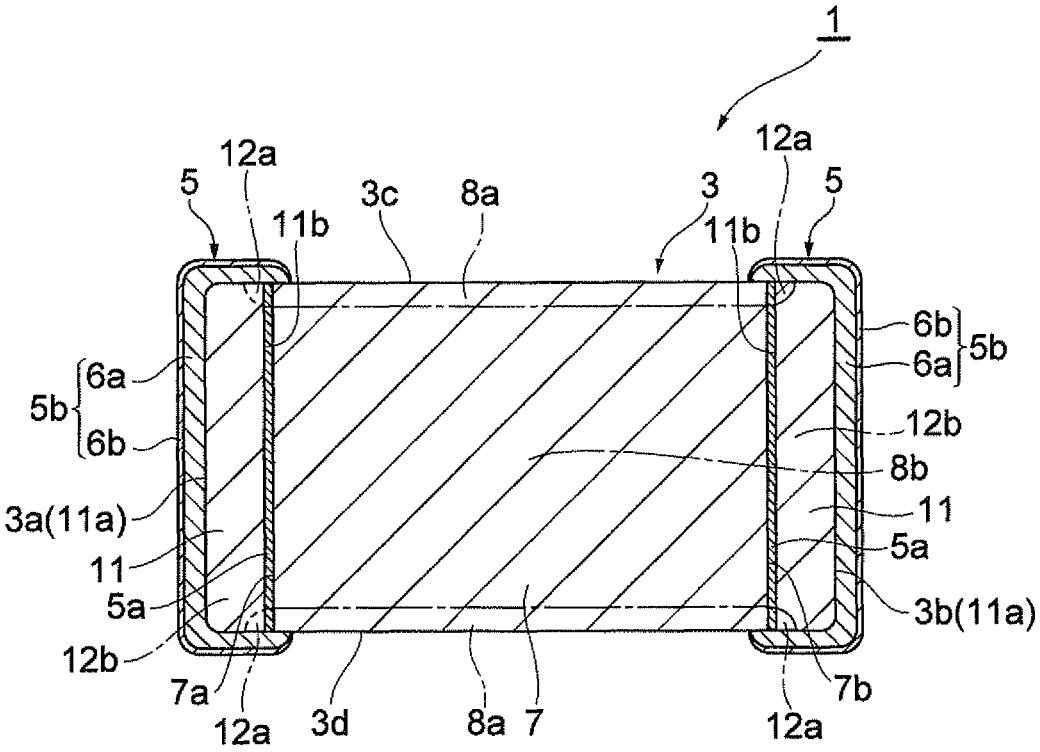
FIG. 8 is a drawing for explaining a cross-sectional configuration of the chip varistor according to a modification example of the embodiment.

A configuration of chip varistor 1 according to a modification example of the present embodiment will be described below with reference to FIG. 8. FIG. 8 is a drawing illustrating a sectional configuration of the chip varistor according to the modification example of the present embodiment.

The chip varistor 1 according to the present modification example is also provided with the element body 3 of a nearly rectangular parallelepiped shape, and the pair of terminal electrodes 5. The chip varistor 1 of the present modification example is different in the sizes of the first and second regions 12*a*, 12*b* of the second varistor sections 11, from the chip varistor 1 of the aforementioned embodiment.

In each of the second varistor sections 11, the second region 12*b* is located nearly in the center of the second varistor section 11, when viewed from the opposing direction of the pair of principal surfaces 11*a*, 11*b*, as the second region 8*b* of each first varistor section 7 is. The second region 12*b* extends between the principal surface 11*a* and the principal surface 11*b*, when viewed from the direction perpendicular to the opposing direction of the paired principal surfaces 11*a*, 11*b*. The second region 12*b* is connected to the first electrode portion 5*a* and the second electrode portion 5*b* (first electrode layer 6*a*). The first region 12*a* is located on the exterior surface side of the second varistor section 11 so as to surround the outer periphery of the second region 12*b*, when viewed from the opposing direction of the pair of principal surfaces 11*a*, 11*b*.

The below will describe an example of a manufacturing process of chip varistors 1 according to the present modification example shown in FIG. 8. The process up to production of a plurality of element bodies 3 is the same as in the manufacturing process of the chip varistors 1 of the aforementioned embodiment and thus the description thereof is omitted herein.

After the plurality of element bodies 3 are obtained, an electroconductive paste is applied so as to cover the two end faces 3*a*, 3*b* of each element body 3 and a thermal treatment is carried out to sinter the electroconductive paste on each element body 3, to form the first electrode layers 6*a* of the second electrode portions 5*b*. Thereafter, electroplating processes such as Ni plating and Sn plating are carried out so as to cover the first electrode layers 6*a*, thereby to form the second electrode layers 6*b*.

The next process is to diffuse at least one element selected from the group consisting of alkali metals (e.g., Li, Na, and so on), Ag, and Cu, from the exposed surface of the element body 3 (four side faces 3*c*-3*f*). A technique of diffusing the at least one element selected from the group consisting of alkali metals, Ag, and Cu is the same as the technique in the aforementioned embodiment.

The chip varistors 1 according to the present modification example are obtained through these processes.

The present modification example also achieves reduction in capacitance while maintaining a sufficient ESD tolerance, and securely prevents the variation in capacitance, as the aforementioned embodiment did.

The chip varistors 1 of the embodiment and the modification example are mounted by soldering so that the opposing direction of the first electrode portions 5*a* becomes parallel to a mount surface of an external substrate or the like.

The above described the preferred embodiments of the present invention, but it should be noted that the present invention is not always limited to the above-described embodiments but may be modified in may ways without departing from the scope and spirit of the invention.

Each first electrode portion 5*a* does not always have to be formed so as to cover the entire area of the principal surface 7*a* or 7*b* of the first varistor section 7. However, in order to suppress the variation in the capacitance of the chip varistor 1, each first electrode portion 5*a* preferably covers at least a region corresponding to the second region 8*b* in the principal surface 7*a* or 7*b*. It is a matter of course that, for connection to the second electrode portion 5*b*, at least a part of each first electrode portion 5*a* needs to be exposed in the four side faces 3*c*-3*f* of the element body 3. The first electrode portion 5*a* may be composed of a plurality of segments.

The element body 3 may be constructed without the second varistor sections 11. In this case, the first electrode portion 5*a* and the second electrode portion 5*b* are connected directly to each other. When the element body 3 is constructed without the second varistor sections 11, it is preferable to diffuse the at least one element selected from the group consisting of alkali metals, Ag, and Cu, after the formation of the second electrode portions 5*b* on the element body 3. By this process, each first electrode portion 5*a* is surely connected to the second region 8*b* of the first varistor section 7.

The first varistor section 7 may contain Bi, instead of the rare earth metal. The first varistor section 7 may contain the rare earth metal and Bi.

In the embodiment and the modification example of the present invention the first regions 8*a*, 12*a* are located on the exterior surface side of the element body 3 so as to surround the outer peripheries of the second regions 8*b*, 12*b*, when viewed from the opposing direction of the pair of end faces 3*a*, 3*b*, but the present invention does not have to be limited to it. For example, they may be located on the side of one side face out of the four side faces 3*c*-3*f* or on the sides of two side faces out of the four side faces 3*c*-3*f*.

The element body 3 may be one without diffusion of the at least one element selected from the group consisting of alkali metals (e.g., Li, Na, and so on), Ag, and Cu.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A chip varistor comprising:

a varistor section comprised of a sintered body containing ZnO as a major component, configured to exhibit the nonlinear voltage-current characteristics, and having a pair of principal surfaces opposed to each other; and a plurality of terminal electrodes connected to the varistor section, wherein each of said terminal electrodes has a first electrode portion connected to either of the principal surfaces and a second electrode portion connected to the first electrode portion, wherein the varistor section includes a first region where at least one element selected from the group consisting of alkali metals, Ag, and Cu exists, and a second region extending between the pair of principal surfaces and containing no element selected from the group consisting of alkali metals, Ag, and Cu, and wherein the first electrode portions are connected to the second region.

2. The chip varistor according to claim 1, wherein the first electrode portions are arranged so as to cover the respective principal surfaces.

3. The chip varistor according to claim 1, wherein the first electrode portions are formed by co-firing an electroconductive paste containing a metal and containing no glass component, together with the varistor section.

4. The chip varistor according to claim 1, wherein the varistor section contains at least one element selected from the group consisting of rare earth metals and Bi, as a minor component.

5. The chip varistor according to claim 1, wherein the first region of the varistor section is located on the exterior surface side of the varistor section so as to surround an outer periphery of the second region of the varistor section, when viewed from an opposing direction of the pair of principal surfaces.

6. The chip varistor according to claim 1, further comprising:

another varistor section arranged so that the first electrode portion is sandwiched in between the varistor sections.

* * * * *